US007160135B1

(12) United States Patent
Wu

(10) Patent No.: US 7,160,135 B1
(45) Date of Patent: Jan. 9, 2007

(54) STACKED CONNECTOR ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/322,692

(22) Filed: Dec. 30, 2005

(51) Int. Cl.
*H01R 13/627* (2006.01)

(52) U.S. Cl. ..... 439/352; 439/701; 439/160

(58) Field of Classification Search ..... 439/701, 439/160, 352
See application file for complete search history.

(56) References Cited

U.S. PATENT DOCUMENTS

| | | | | |
|---|---|---|---|---|
| 5,531,612 | A | 7/1996 | Goodall et al. | |
| 5,564,939 | A | 10/1996 | Maitani et al. | |
| 5,761,805 | A | 6/1998 | Guyer | |
| 5,766,033 | A | 6/1998 | Davis | |
| 5,797,771 | A | 8/1998 | Garside | |
| 6,071,149 | A | 6/2000 | Hara | |
| 6,165,006 | A | 12/2000 | Yeh et al. | |
| 6,183,273 | B1 | 2/2001 | Yu et al. | |
| 6,193,547 | B1 | 2/2001 | Tung | |
| 6,227,904 | B1 | 5/2001 | Wang et al. | |
| 6,447,170 | B1 * | 9/2002 | Takahashi et al. | 385/53 |
| 6,524,130 | B1 | 2/2003 | Yeh | |
| 6,592,390 | B1 * | 7/2003 | Davis et al. | 439/352 |
| 6,648,665 | B1 | 11/2003 | Wu | |
| 6,659,790 | B1 | 12/2003 | Wu | |
| 6,736,676 | B1 | 5/2004 | Zhang et al. | |
| 6,749,458 | B1 | 6/2004 | Kuo et al. | |
| 6,866,533 | B1 | 3/2005 | Wu | |
| 6,885,560 | B1 * | 4/2005 | Zaremba | 361/754 |
| 6,887,091 | B1 | 5/2005 | Wu | |
| 6,887,101 | B1 | 5/2005 | Ito et al. | |
| 6,896,542 | B1 | 5/2005 | Chang | |

OTHER PUBLICATIONS

"SFF-8088 Specification for Compact Multilane Series: Shielded" published on Jun. 27, 2005 by SFF Committee.

* cited by examiner

*Primary Examiner*—Truc Nguyen
(74) *Attorney, Agent, or Firm*—Wei Te Chung

(57) ABSTRACT

A cable connector assembly (500) includes a number of connector bodies (100) each defining a mating port for mating with complementary connectors and a common housing (200) encapsulating the connector bodies therein with the mating ports exterior accessible. Each of the connector bodies includes a latch member (3) assembled on one side thereof. The connector bodies are arranged in an upper row and a lower row such that the mating ports of the upper row and lower row are in a substantially mirror-image disposition relative to a line between the upper and lower rows.

15 Claims, 16 Drawing Sheets

STACKED CONNECTOR ASSEMBLY

CROSS-REFERENCE TO RELATED APPLICATIONS

This application is related to U.S. patent application Ser. No. 11/201,521 filed on Aug. 11, 2005 and entitled "CABLE CONNECTOR ASSEMBLY WITH LATCHING MECHANISM", U.S. patent application Ser. No. 11/201,461 filed on Aug. 11, 2005 and entitled "CABLE CONNECTOR ASSEMBLY WITH LATCHING MECHANISM", and U.S. patent application Ser. No. 11/213,048 filed on Aug. 26, 2005 and entitled "CABLE CONNECTOR ASSEMBLY WITH EMI GASKET", all of which have the same applicant and assignee as the present invention. The disclosure of these related applications is incorporated herein by reference. This application is also related to U.S. Pat. No. 6,951,479 filed on Jul. 20, 2004, issued on Oct. 4, 2005 and entitled "STACKED CONNECTOR ASSEMBLY HAVING A PAIR OF LATCH ARMS", which has the same applicant and assignee as the present invention.

BACKGROUND OF THE INVENTION

1. Field of the Invention

The present invention generally relates to a connector assembly, and more particularly to a connector assembly used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products. Specification SFF-8088 defines matable Compact Multilane Shielded connectors adopted for being used in laptop portable computer to connect small-size disk drives to a printed circuit board. The connectors comprise a cable connector assembly connecting with the small-size drive and a header mounted on the printed circuit board. The cable connector assembly defined in the specification comprises a pair of engageable metal housings together defining a receiving space therebetween, a PCB received in the receiving space, a cable comprising a plurality of conductors electrically connecting with the PCB, and a latching mechanism assembled to a top surface of the upper metal housing. The latching mechanism comprises an elongated T-shape latch member for latching with the header mentioned above and a pulling member cooperating with the latch member for actuating the latch member to separate from the header. With the compact trend of electronics, the density of the electronic components, including the cable connector assembly mentioned above, arranged on a panel of computer are increased rapidly. Such a cable connector assembly with latch member and pulling member will occupy relative more space than others, especially when using more than one such cable connector assembly. Thus, how to spare the occupied space of the cable connector assemblies is desired to be solved in the art.

BRIEF SUMMARY OF THE INVENTION

Accordingly, an object of the present invention is to provide a stacked connector assembly which spare occupied space thereof on a panel to which the cable connector assembly is mounted.

In order to achieve the above-mentioned object, a cable connector assembly in accordance with the present invention comprises a plurality of connector bodies respectively defining a mating port for mating with complementary connectors and a common shell encapsulating the connector bodies therein with the mating ports exterior accessible. Each of the connector bodies further comprises a latch member assembled on one side thereof. The connector bodies are arranged in an upper row and a lower row such that the mating ports of the upper row and lower rows are in a substantially mirror-image disposition relative to a line between the upper and lower rows.

Other objects, advantages and novel features of the invention will become more apparent from the following detailed description of the present embodiment when taken in conjunction with the accompanying drawings.

DETAILED DESCRIPTION OF THE INVENTION

Figure 1:
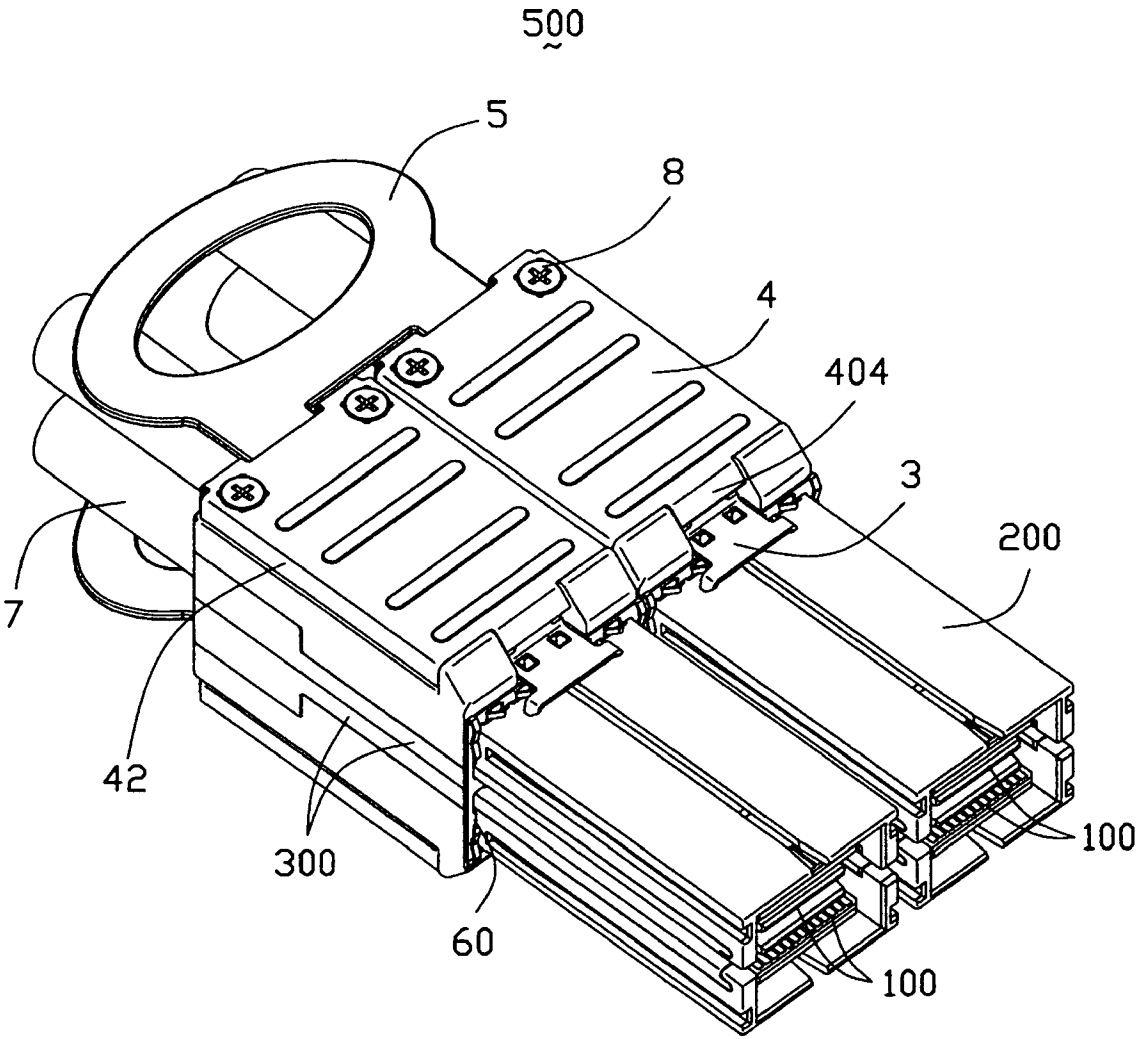
FIG. 1 is an assembled, perspective view of a connector assembly in accordance with the first embodiment of the present invention.

Reference will now be made to the drawing figures to describe the present invention in detail.

Figure 2:
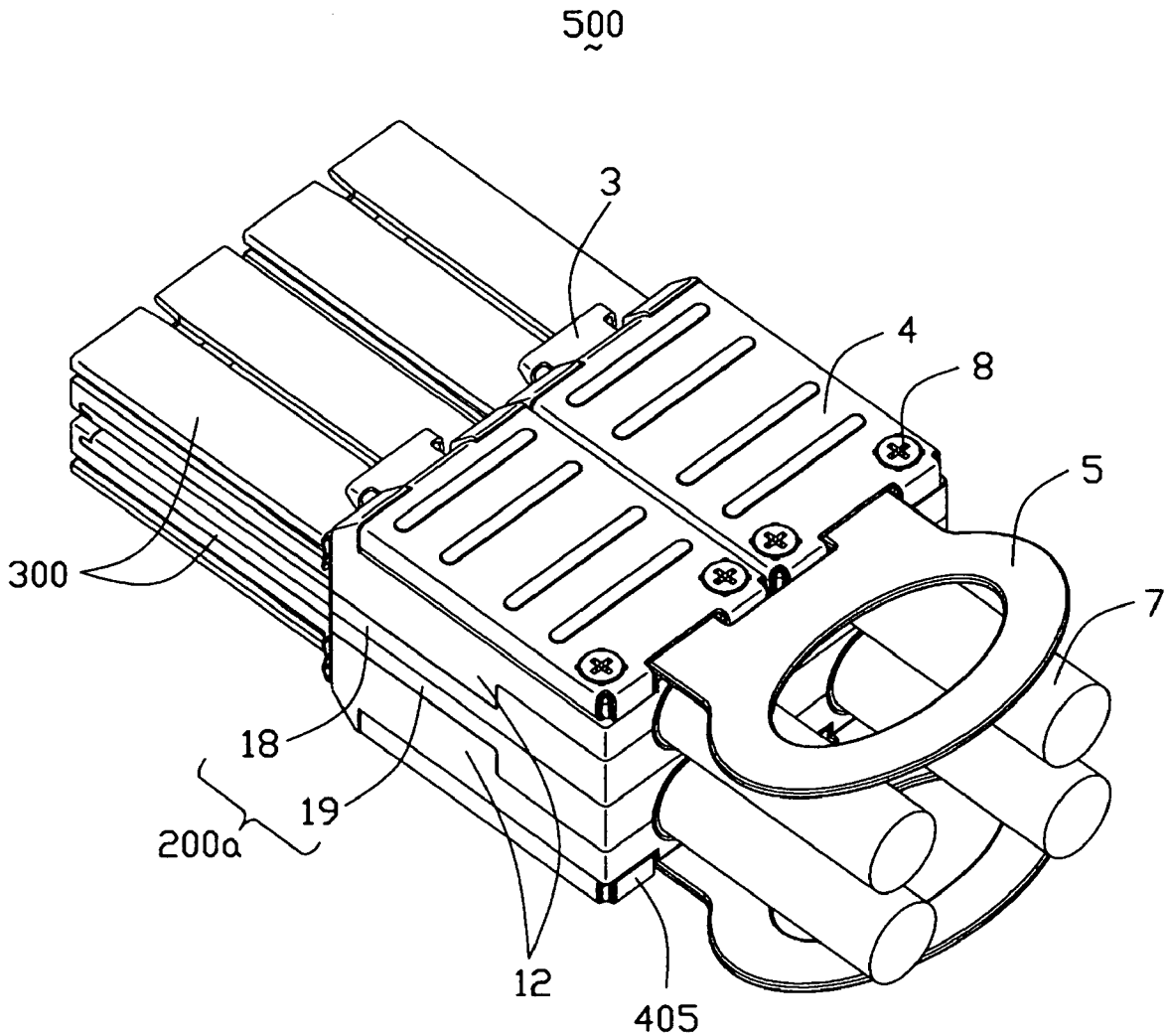
FIG. 2 is a view similar to FIG. 1, but viewed from a different aspect.
Figure 3:
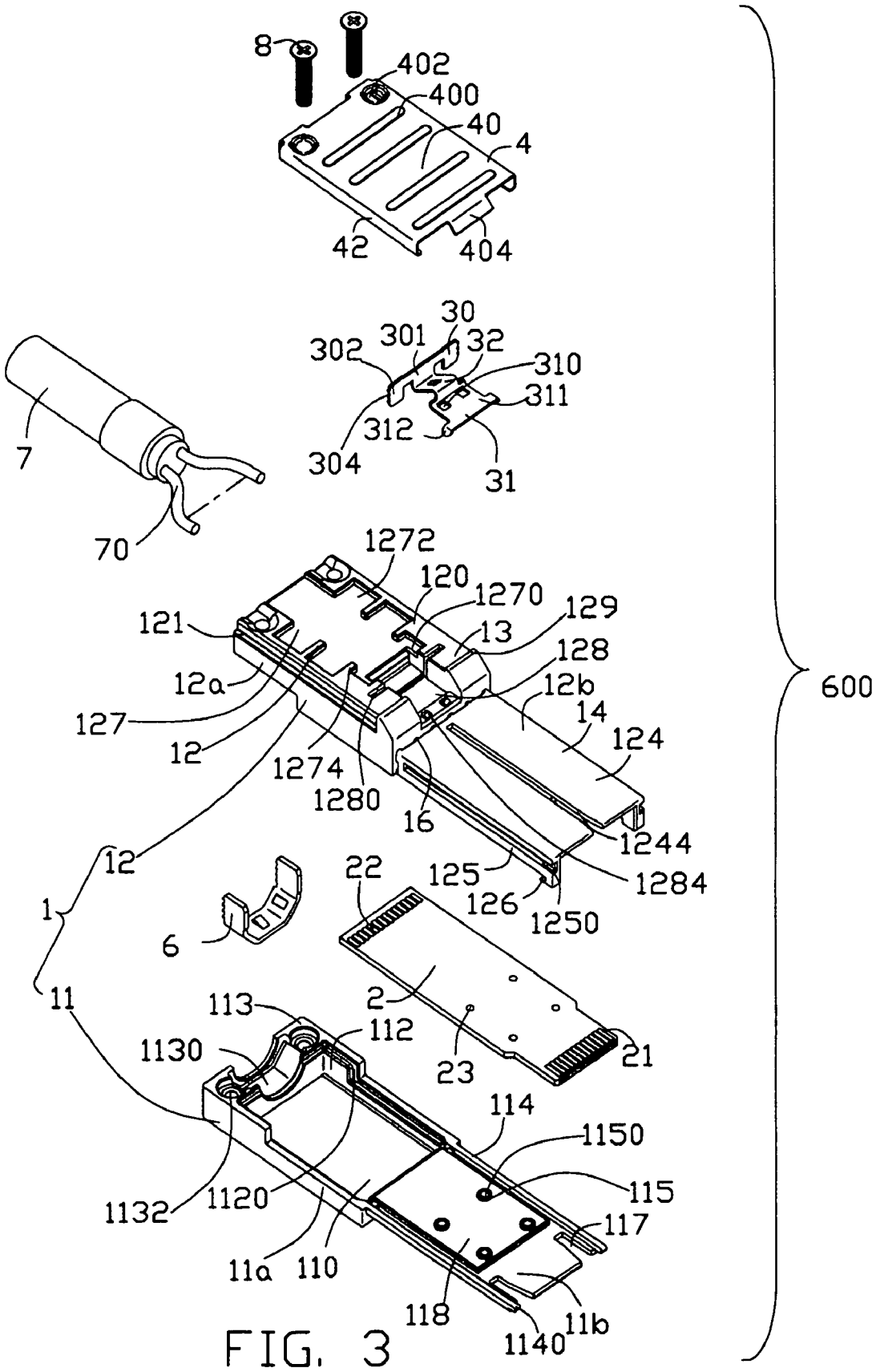
FIG. 3 is an exploded, perspective view of a unit of the cable connector assembly of FIG. 1.
Figure 4:
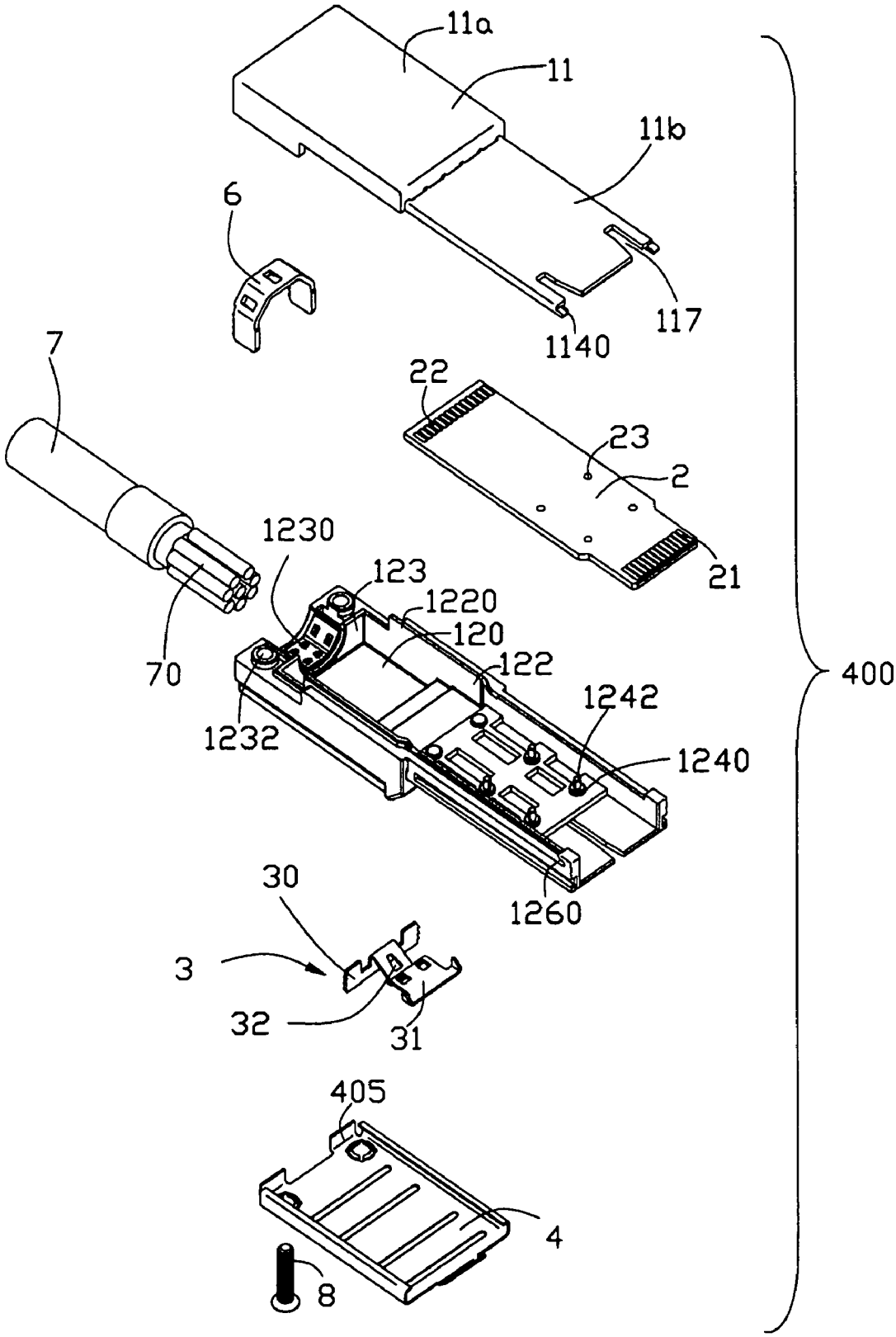
FIG. 4 is a view similar to FIG. 1, but viewed from a different aspect.

Referring to FIGS. 1–4, a connector assembly 500 in accordance with the first embodiment of the present invention is formed with four connector bodies 100, a common housing 200 encapsulating the connector bodies 100 therein, four latch members 3 assembled on the common housing 200 for latching with complementary connectors and a pair of pulling members 5 each cooperating with a pair of juxtaposed arranged latch members 3 for actuating the juxtaposed arranged connector bodies 100 to unlatch from the complementary connectors. From another aspect, the connector assembly 500 in accordance with the present invention is formed with a pair of stacked cable assemblies 300, and each of the cable assemblies 300 comprises a pair of juxtaposed connector bodies 100, a shielding housing (not labeled) enclosing the connector bodies 100 and a latch mechanism (not labeled) assembled thereto. The connector assembly 500 also can be seemed as formed with four interconnecting sub-connectors 600 with a pair of pulling members 5 assembled thereon. The sub-connectors 600 are configured in the substantially same structure. As shown in FIG. 3 and FIG. 4, each of the sub-connectors 600 comprises a metal housing 1, a printed circuit board (PCB) 2 located in the metal housing 1, a cable 7 electrically connecting with the PCB 2, a latch member 3 assembled to the metal housing 1 latchable to a complementary connector (not shown), a metal shell 4 assembled to the metal housing 1 to cooperate with the latch member 3. The latch members 3 and the corresponding pulling member together form a manual operable latch mechanism (not labeled).

Please refer to FIGS. 1–8, the metal housing 1 comprises a base 11, a cover 12 engageable with the base 11 and a receiving space 15 formed between the base and the cover 11, 12. The metal housing 1 also comprises a rectangular base portion 13 and an elongated tongue portion 14 extending forwardly from the base portion 13.

The base 11 comprises a first base section 11*a* and a first tongue section 11*b* extending forwardly from the first base section 11*a*. The first base section 11*a* comprises a first flat portion 110, a pair of first flanges 112 and a first rear wall 113 extending upwardly from opposite side edges and rear edge of the first flat portion 110. The front portions of the first flanges 112 are cut to present the first flanges 112 L-shaped. A first substantially semicircular opening 1130 is defined in the first rear wall 113 and a pair of first screw holes 1312 are defined in the first rear wall 113 and located at opposite sides of the first semicircular opening 1130. A first slit 1120 extends downwardly from a top surface of the first base section 11*a* and into the first flanges 112 and a front portion of the first rear wall 113. The first tongue section 11*b* comprises a first panel 118 formed with a pair of ribs 114 located at opposite sides thereof. Each rib 114 forms a tip end 1140 extending beyond a front edge of the flat portion 118. The first panel 118 also forms two pairs of first standoffs 115 spaced arranged thereon, and each first standoff 115 defines a first positioning hole 1150 therein. A pair of U-shape cutouts 117 extend rearward from the front edge of the first panel 118 and respectively locate adjacent to corresponding ribs 1140.

The cover 12 comprises a second base section 12*a* and a second tongue section 12*b* extending forwardly from the second base section 12*a*. The second base section 12*a* comprises a second flat portion 120, a pair of second flanges 122 and a second rear wall 123 extending downwardly from opposite side edges and a rear edge of the second flat portion 120. The rear portions of the second flanges 122 and the second rear wall 123 are cut to present the second flanges 122 L-shaped. A second substantially semicircular opening 1230 is defined in the second rear wall 123. A pair of second screw holes 1232 are defined through the second rear wall 123 and locate at opposite sides of the second semicircular opening 1230. Corresponding to the first slit 1120 of the base 11, a continuous protruding ridge 1220 integrally extend downwardly from inner edges of the second flanges 122 and the second rear wall 123. The second flat portion 120 defines a first recess section 127 consisting of different-size first and second recesses 1270, 1272, and a deeper and narrower second recess section 128 formed in a front portion of the second flat portion 120 to communicate with a front surface of the second flat portion 120. A deeper slit 1280 is defined in the front portion of the second flat portion 120 and extends in a direction perpendicular to that of the second recess section 128 to communicate with the second recess section 128. A transversely-extending bar 1282 is formed at a front end of the second recess section 128 with a pair of projections 1284 arranged thereon. A pair of first channels 121 are respectively defined in opposite sides of the first flat portion 12*a* extending in a back-to-front direction. A pair of rims 129 are formed at the front portion of the first flat portion 12*a*.

The second tongue section 12*b* comprises a second panel 124 formed with a long keyway 1244 and a pair of side walls 125 extending downwardly from opposite sides of the second panel 124. A pair of second channels 1250 are defined in corresponding side walls 125 opened toward outside for guiding an insertion of a complementary connector (not shown). A pair of protrusions 126 extend rearward from a front surface of the second tongue section 12*b* and respectively locate below the side walls 125 to form a pair of gaps 1260 therebetween. The second panel 124 forms a enhancing portion (not labeled) on a bottom surface thereof for enhancing the strength thereof and three pairs of second standoffs 1240 are symmetrically arranged on the enhancing portion with two pairs of second standoffs 1240 formed with posts 1242 extending downwardly. The first and second standoffs 115, 1240 with the first and second positioning holes 1150, 1242 are served as first engaging means of the housing 1. The first engaging means is not limited to the structures described above, it also can be protrusions protruding from the first and second tongue sections 11*b*, 12*b*, or recesses recessed from the first and second tongue sections 11*b*, 12*b*.

The PCB 2 is formed with a plurality of first conductive pads 21 aligned at a front end thereof and a plurality of second conductive pads 22 aligned at an opposite rear end thereof with different amount from that of the first conductive pads 21. The first and second conductive pads 21, 22 electrically connect with one another through inner traces disposed in the PCB 2. Two pairs of holes 23 are symmetrically arranged on the PCB 2 adjacent to the first conductive pads 21. The holes 23 are served as second engaging means of the PCB 2. The second engaging means is also not limited to the structures described above, it can be standoffs with holes to receive the respective protrusions of the first engaging means of the housing 1, or different-shape projections formed on opposite surfaces of the PCB to be received in the recesses of the first engaging means of the housing 1.

The latch member 3 is made of metal material and is a cantilever-type member. The latch member 3 comprises a N-shape engaging portion 30 located in a vertical surface, a flat latching portion 31 located in a horizontal surface perpendicular to the vertical surface and an inclined connecting portion 32 connecting the engaging portion 30 with the latching portion 31 to provide spring force to the latch member 3. The engaging portion 30 comprises a transverse bar section 301 and a pair of side sections 302 extending downwardly from opposite sides of the bar section 301. Each side section 302 is formed with barbs 304 on outmost edge thereof. The flat latching portion 31 defines a pair of rectangular holes 310 at a rear portion thereof adjacent to the connecting portion 32 and a pair of latches 312 bending downwardly from opposite sides of the front edge thereof. The connecting portion 32 connects with middle portion of the bar section 301 and extends upwardly from a lower edge of the bar section 301. The connecting portion 32 also defines a hole therein for adjusting spring force of the latch member 3 through changing size and shape of the hole.

The conductive shell 4 comprises a body portion 40 formed with a plurality of bars 400 on a top surface for increasing friction and a pair of L-shape lateral walls 42 extending downwardly from opposite sides of the body portion 40. A pair of holes 402 and a downwardly-extending first tab 404 are respectively formed in a rear portion and a front edge of the body portion 40. A pair of second tabs 405 are formed with the body portion 40 extending downwardly from a rear edge of the body portion 40.

Figure 7:
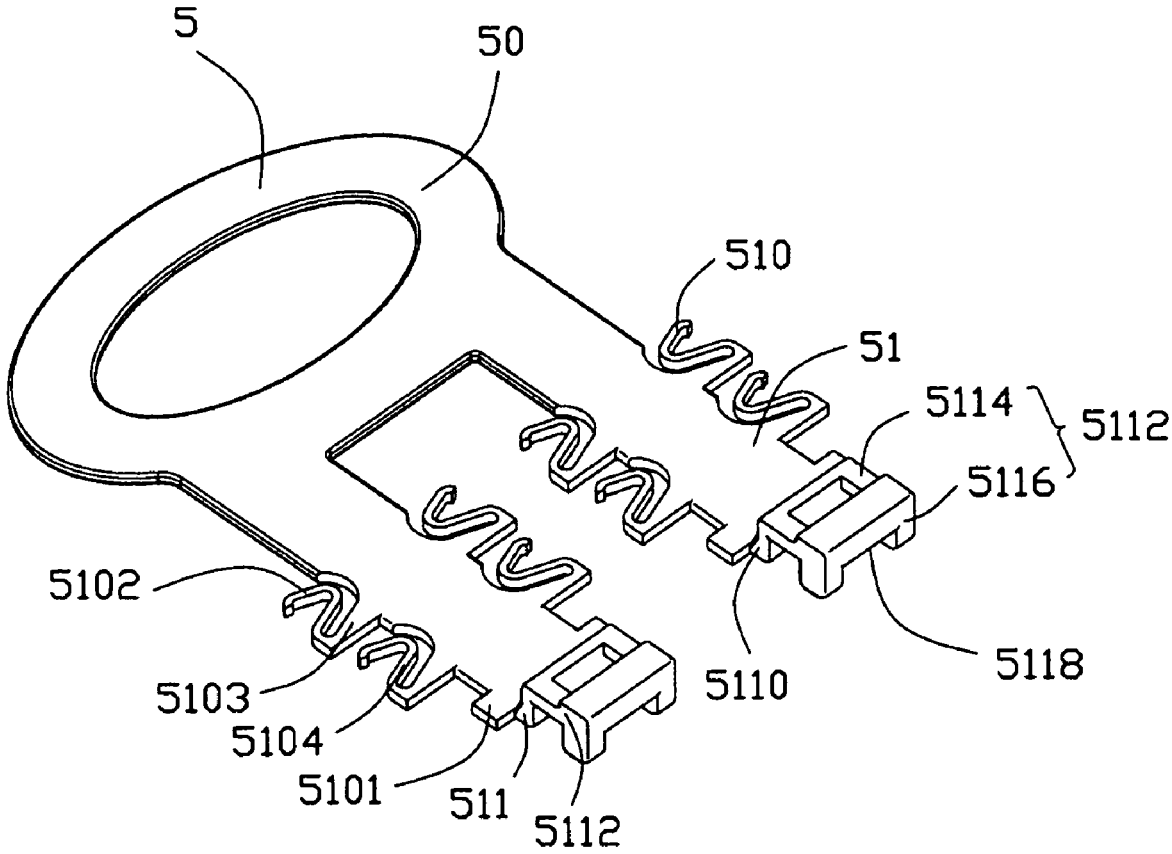
FIG. 7 is an enlarged view of a common pulling member of FIG. 1.
Figure 8:
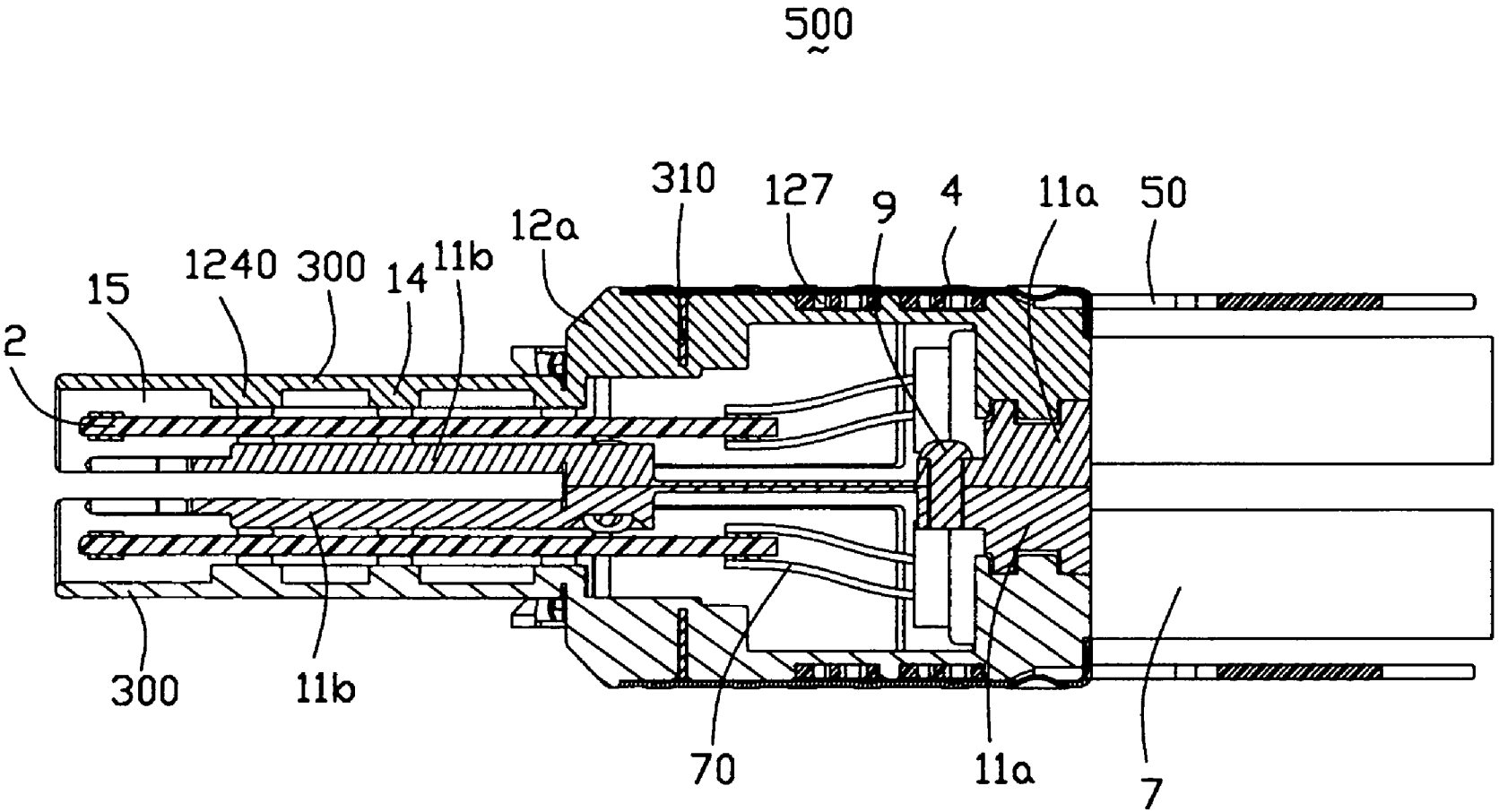
FIGS. 8–11 are cross-section views taken along lines 8—8 to 11—11 of FIG. 1.
Figure 9:
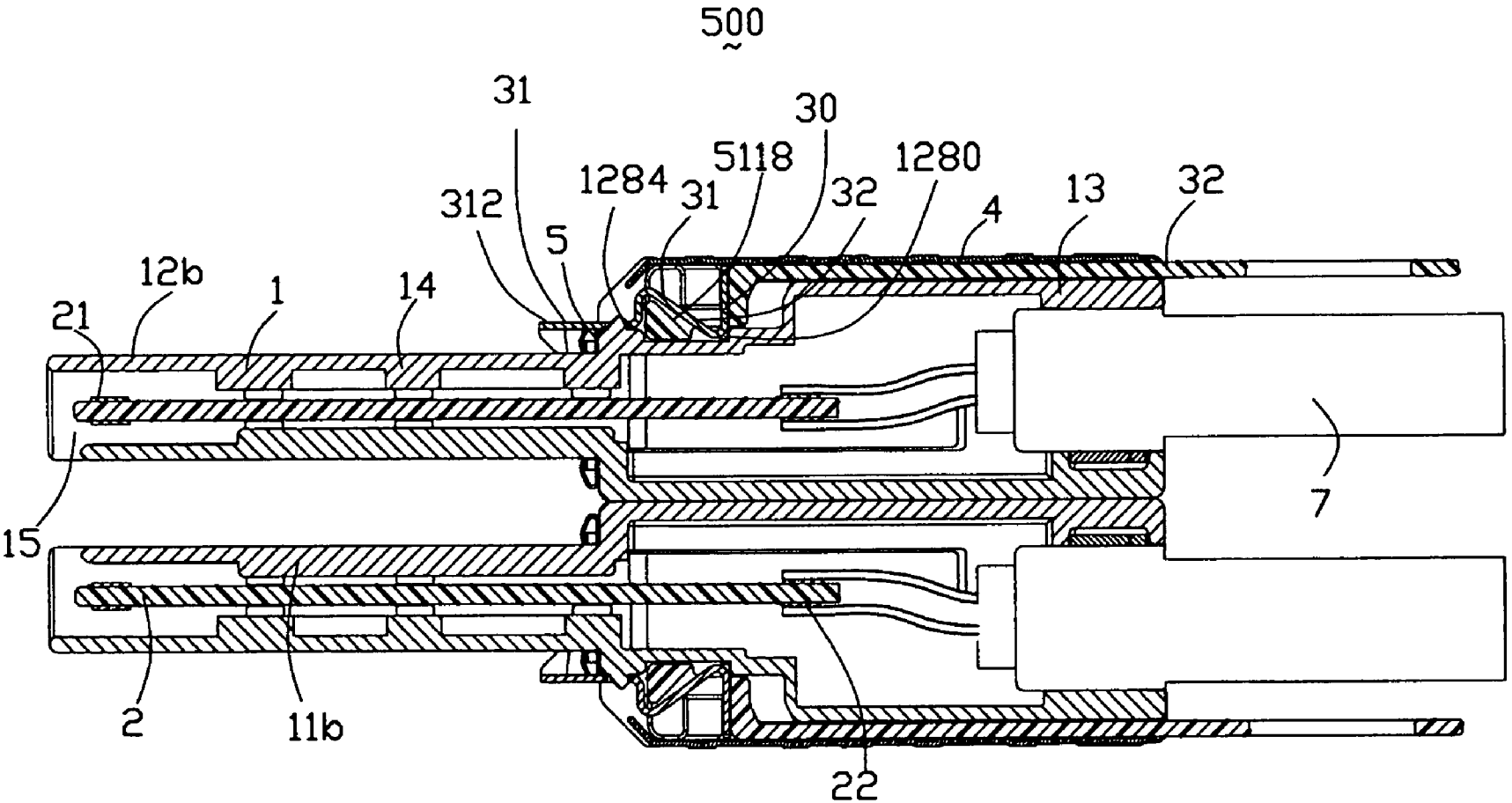
Figure 10:
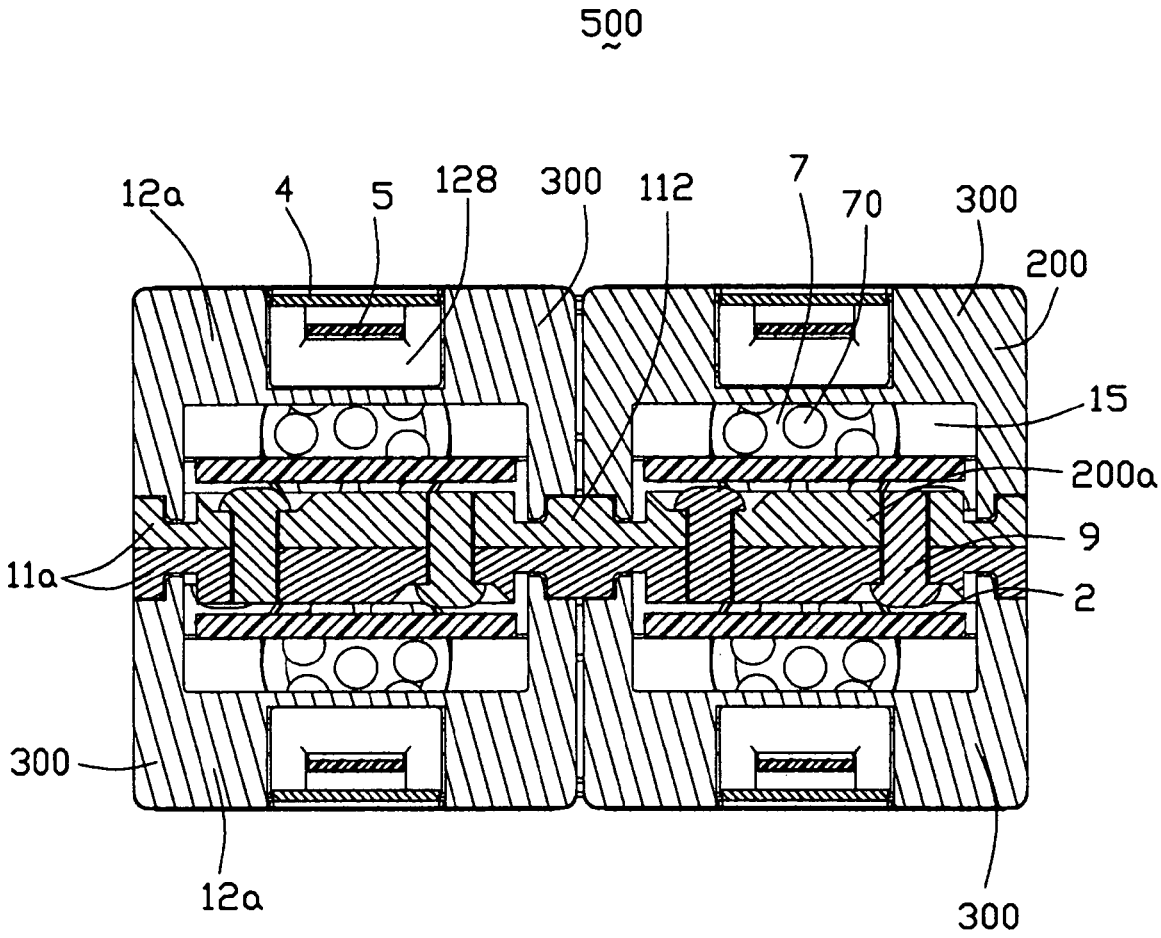

Referring to FIG. 7, the pair of pulling members 5 are made by insulative material and each comprises a rear ring-shape operating portion 50, a pair of elongated forwardly extending engaging legs 51. Each of the engaging legs 51 comprises a plurality of interference portion 510 formed on opposite sides thereof and a forward cooperating portion 511 at a front end thereof. The interference portion 510 comprises a pair of stop sections 5101 located adjacent to the cooperating portion 511 and two pairs of elastic sections 5102 formed at middle portion of the intermediate portion 510. Each elastic section 5102 comprises a transverse block section 5103 and a V-shape claw section 5104 extending rearward from the block section 5103. The cooperating portion 511 comprises a vertical section 5110 and a body section 5112 extending forwardly from the vertical section 5110. The body section 5112 forms a pair of forwardly extending ribs 5114 with tip end formed with enlarged protrusions 5116. A slanted surface 5118 (FIG. 9) downwardly and rearward extends from a front surface of the body section 5112.

Figure 5:
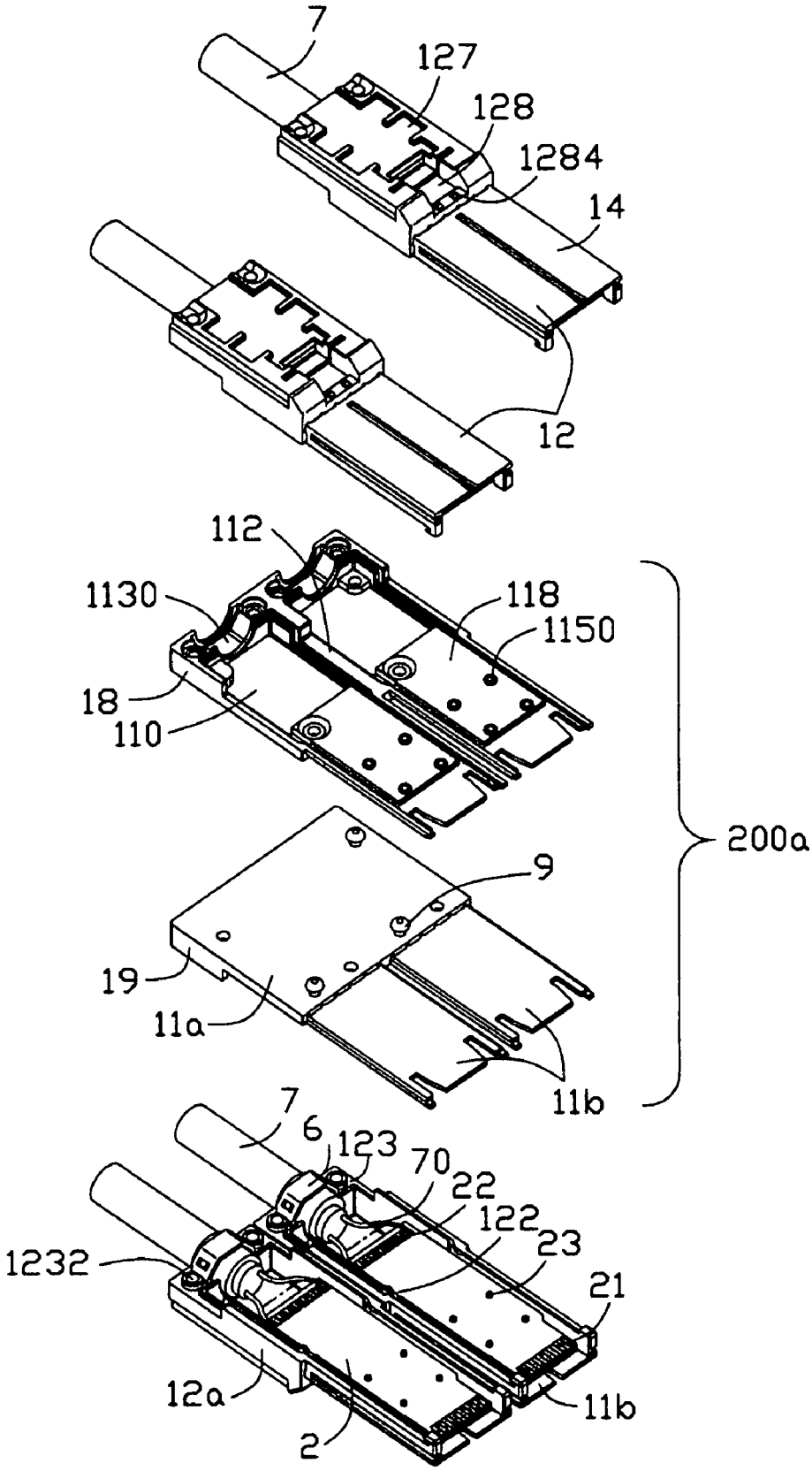
FIG. 5 is an exploded, perspective view of the upper row of the cable connector assembly of FIG. 1.
Figure 6:
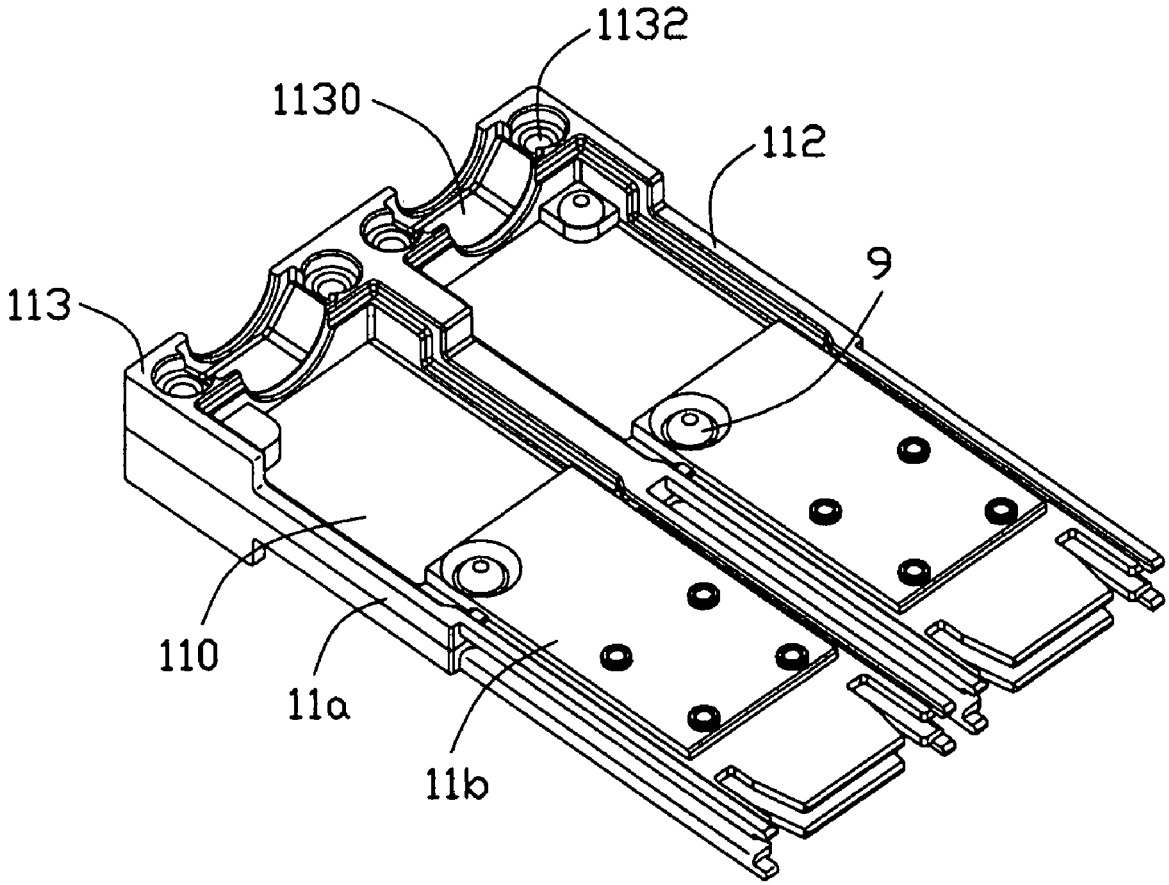
FIG. 6 is an enlarged view of a common base of the cable connector assembly of FIG. 1.

Particularly referring to FIG. 5 and FIG. 6, for simplifying assembling of the cable connector assembly 500, the four bases 11 are arranged in an upper row and a lower row, moreover, the pair of bases 11 in the upper row are integrated into a first base portion 18 while the pair of bases 11 in the lower row are integrated into a second base portion 19. The first flanges 112 of the pair of bases 11 are integrated together. Further, the first base portion 18 and the second base portion 19 are combined by three nails 9 and thus forms a common base 200*a*. The common base 200*a* and the covers 12 together form the common housing 200 encapsulating the connector bodies 100 of the connector assembly 500. The four covers 12 also can be integrated into two unitary cover members (not shown), if desired.

Figure 13:
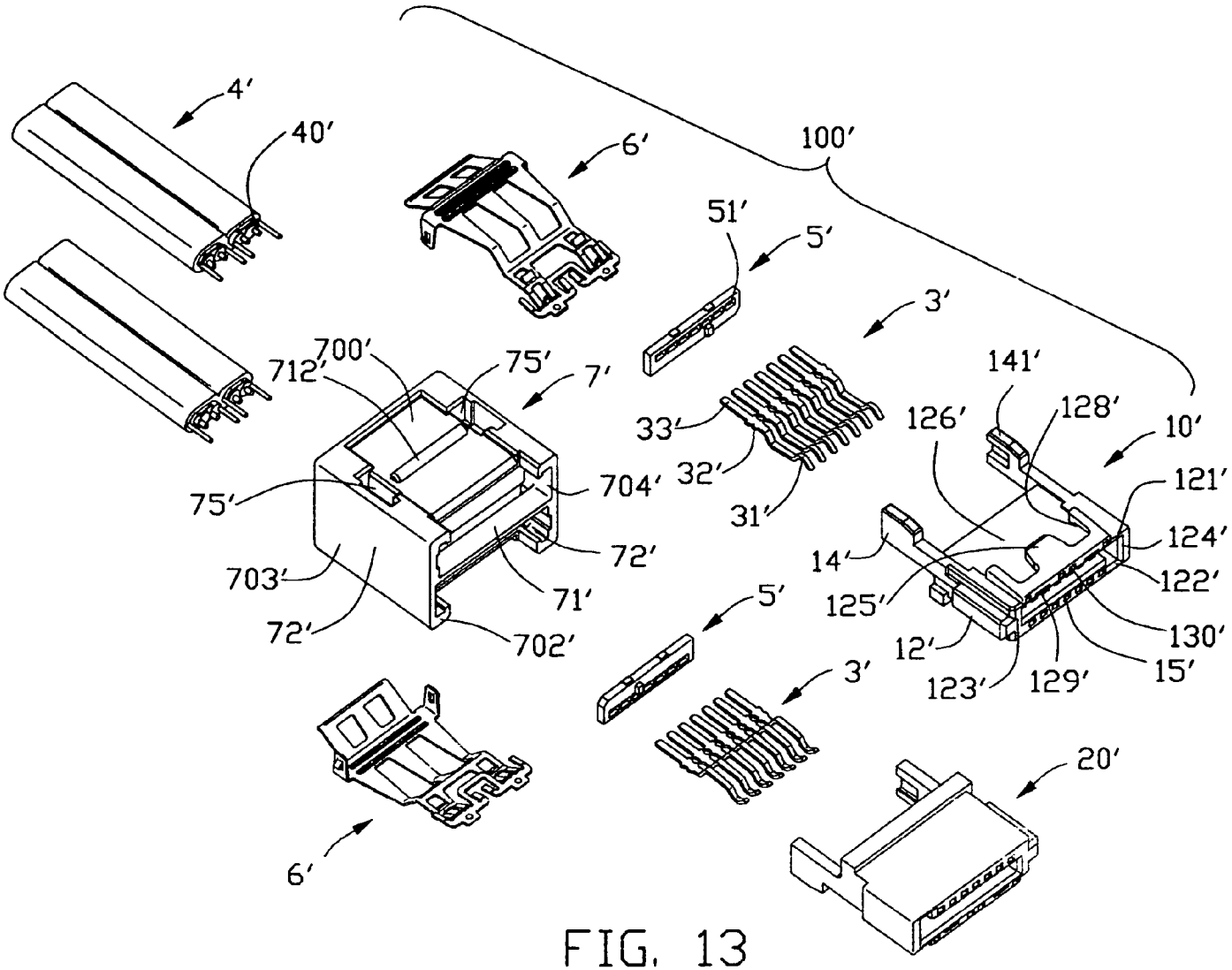
FIG. 13 is a view similar to FIG. 12, but viewed from anther aspect.

In assembly, conductors 70 of the cables 7 are respectively soldered to the second conductive pads 22 of the corresponding PCBs 2 to form the connector bodies 100. The connector bodies 100 are positioned in the first and second base portions 18, 19 in a side-by-side manner. Specifically, the PCB 2 with the cable 7 is located on the first standoffs 115 of the base 11 with the holes 23 aligned with the first positioning holes 1150 and the cable 7 is located in the first semicircular opening 1130 of the base 11. Each of the sub-connectors 600 of the present invention may have a cable holder 6 grasping a metal braiding area exposed outside of the cable 7 to provide strain relief to the cable 7. The cover 12 is assembled to the base 11 and the PCB 2 with the posts 1242 protruding through the holes 23 and the first positioning holes 1150 to position the PCB 2 in the receiving space 15 of the housing 1. The PCB 2 is sandwiched between the base 1 and the cover 12 by the first and second engaging means engaging with each other. The protruding ridge 1220 of the cover 12 is received in the first slit 1120 of the base 11 and the pair of tip ends 1140 received in the gaps 1260, thus, the base 11 and the cover 12 are also securely assembled together. The first and second screw holes 1132, 1232 combine into a screw receiving space 17 (FIG. 13).

Figure 11:
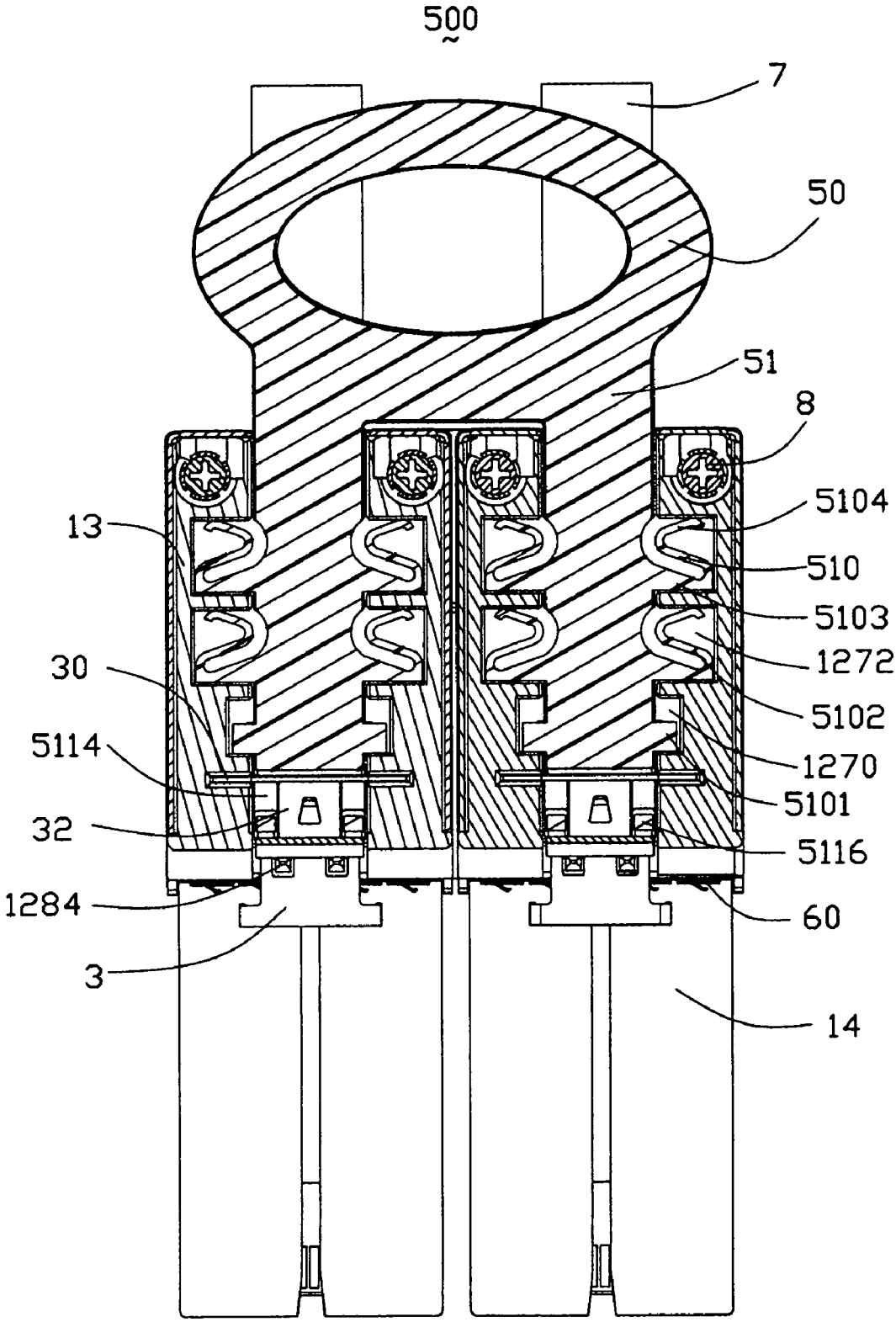

Referring to FIG. 11 in conjunction with FIGS. 1–2, the latch mechanism are assembled to the covers 12 along a vertical direction perpendicular to the front-to-back direction. The engaging legs 51 of the pulling member 5 are firstly pressed to the corresponding covers 12. The cooperating portions 511 of the pulling member 5 are received in the second recess sections 128 of the covers 12, and the interference portions 510 are respectively received in the first recess sections 127. The stop sections 5101 and the elastic sections 5102 are respectively slideably received in the different-size first and second recesses 1270, 1272 with the block sections 5103 and the claw sections 5104 respectively abutting against opposite edges of corresponding large-size second recesses 1272. The latch members 3 are respectively assembled to the covers 12 along the vertical direction with the engaging portions 30 interferentially received in the slits 1280. The inclined connecting portion 32 is located on the slanted surface 5118 of the body section 5112 of the cooperating portion 511. The bar section 301 of the latch member 3 are located on the ribs 5114 with the enlarged protrusions 5116 located in front of the bar section 301. The projections 1284 of the cover 12 are respectively received in the rectangular holes 310 and the latches 312 exposed above the second tongue section 12*b*.

The conductive shell 4 are finally assembled to the corresponding covers 12 with the L-shape lateral walls 42 slideably received in the first channels 121 of the covers 12 along a back-to-front direction until front edges of the conductive shells 4 abuts against the rims 129. The first tab 404 is received in the second recess section 128 of the cover 12 and the second tabs 405 respectively locate on steps formed on rear edge of the cover 12. The first tab 404 also presses on the latch member 31 to provide extra return force to the latch member 31 when disengaging the cable connector assembly 100 from the complementary connector. Four pairs of screws 8 are screwed through the holes 402 of the conductive shells 4, the second screw holes 1232 of the covers 12 and the first screw holes 1132 of the bases 11 to retain the conductive shells 4 with the common base 200*a* and the covers 12.

When the complementary connector mates with the sub-connectors 600 of the present invention, contacts of the complementary connectors may electrically connect with the first conductive pads 21 of the PCBs 2 with corresponding structure thereof latches with the latches 3112 of the latch members 3. When the sub-connectors 600 disengage from the complementary connectors, a rearward pulling force exerts to the operating portions 50 of the pulling member 5 to actuate the pulling members 3 rearward move with the elastic sections 5102 and the stop sections 5101 sliding in the second and first recesses 1272, 1270 until the enlarged protrusions 5116 abutting against the bar sections 301 of the latch members 3. The body section 5112 also rearward moves with the slanted surface 5118 sliding along a bottom periphery of the inclined connecting portion 32, thus actuating the connecting portion 32 to pivot upwardly relative to the bar section 301 of the engaging portion 30 and the latches 312 to upwardly move to unlatch from the complementary connector. After the rearward pulling force is removed, restore force of the elastic sections 5102 actuates the pulling member 3 to move forwardly to its original position, and thus, the latch member 3 also reverts to its original position.

The connector assembly 500 of the first embodiment may have a gasket 60 assembled to the common shell 200 for reducing the Electro Magnetic Interference (EMI) in the signal transmission. The gasket 60 is a rectangular frame and stamped from a metal sheet.

Figure 12:
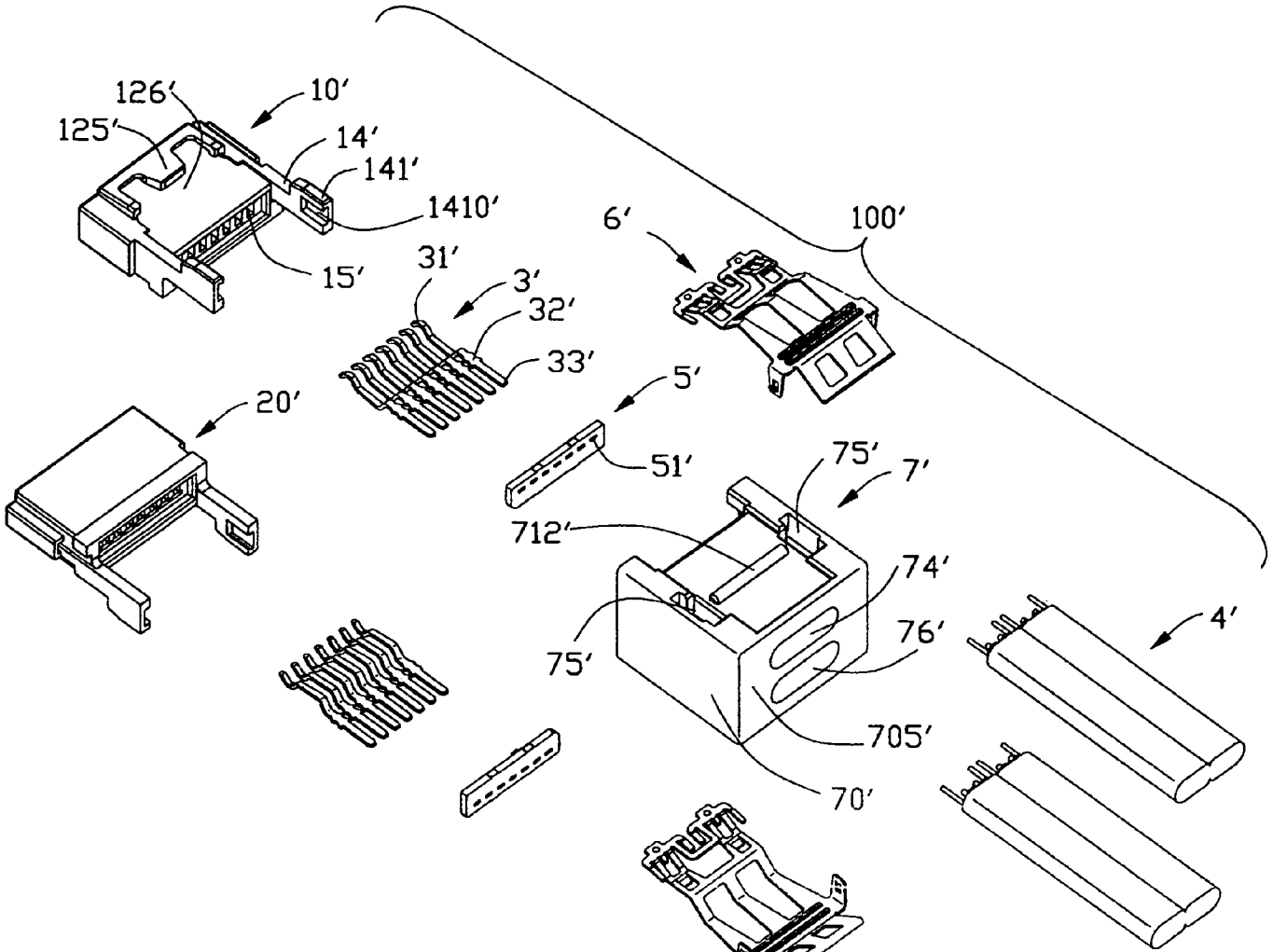
FIG. 12 is an exploded, perspective view of a connector assembly in accordance with the second embodiment of the present invention.

Please refer to FIGS. 12–13, a connector assembly 100' in accordance with the present invention comprises a first insulative housing 10' and a second insulative housing 20', a cover 7' receiving rear portions of the first and the second insulative housings 10', 20', two sets of contacts 3' respectively received in the first and second housings 10', 20', a pair of cables 4' respectively connecting with the contacts 3' received in the first and second housings 10', 20', a pair of spacers 5' respectively sealing the rear portions of the first and second housings 10', 20', and a pair of latch members 6' respectively assembled to the first and second housings 10', 20' and the opposite upper and lower sides of the cover 7'. The first housing 10', half part of the cover 7', one set of contacts 3', one of the cables 4', one of the spacer 5' and one of the latch member 6' forms the first sub-connector, and the other members form the second sub-connector in a stacked relationship relative to the first sub-connector. The connector assembly 100' also can be seen as a common connector housing 7' assembled with a pair of latch members 6' with stacked relationship.

The first insulative housing 10' comprises a base portion 12', and a pair of guiding posts 14' extending backwardly and vertically along the opposite sides of the base portion 12' and beyond the rear end of the base portion 12'. The base portion 12' comprises an upper wall 121', a lower wall 122' opposite to the upper wall 121', and a pair of sidewalls 123', 124' connecting with the upper wall 121' and the lower wall 122'. The upper wall 121', the lower wall 122' and the sidewalls 123', 124' together define an L-shaped interface therebetween for matching with complementary connector (not shown). The lower wall 122' of the base portion 12' defines a plurality of passageways 15' extending therethrough along a front-to-back direction. The upper wall 121' of the base portion 12' defines a depression 126' recessed from an upper surface thereof. A flat portion 125' protrudes upwardly and rearwardly from a middle portion of a front flange of the upper wall 121' into the depression 126'. A gap 128' is formed between the flat portion 125' and a bottom surface of the depression 126'. The upper wall 121' further defines a pair of first slots 129' and two pairs of second slots 130' in communication with the gap 128'. Each guiding post 14' defines a free end 141' with a cutout 1410' thereon.

The second insulative housing 20' has the same structure as that of the first insulative housing 10'.

The cover 7' comprises a rectangular body portion 70'. The body portion 70' is formed with a top wall 700', an opposite bottom wall 702', a pair of side walls 703', 704' parallelly extending between the top and the bottom walls 700', 702', and a rear wall 705' connecting the top, the bottom and the side walls. A first and a second receiving space 71', 72' are parallelly arranged in an upper and lower manner between the top and the bottom walls 700', 702' for receiving corresponding portions of the first and second insulative housings 10', 20'. A pair of passages 75' vertically extend through the top wall 700' to the bottom wall 702' in communication with the receiving spaces 71', 72' and locate at opposite sides of the cover 7' for receiving corresponding free ends 141' of the guiding posts 14'. A first channel 74' and a second channel 76' are recessed forwardly from the rear wall 705' of the body portion 70' to communicate with corresponding receiving space 71', 72'. The top wall 700' further comprises a holding bar 712' transversely formed thereon. The bottom wall 702' has the same structure as that of the top wall 700'.

The two sets of contacts 3' are respectively disposed in the passageways 15' of the first and the second insulative housings 10', 20'. Each of the contacts 3' comprises a curved contact portion 31' exposed in a corresponding passageway 15' of the insulative housing 10', 20', a retention portion 32' engaged with interior sides of the corresponding passageway 15', and a tail portion 33' horizontally extending from the retention portion 32' to electrically connect with corresponding cable 4'.

Each cable 4' comprises a plurality of individual conductors 40' for being respectively soldered to the tail portions 33' of the contacts 3'.

The spacers 5' are respectively mounted to the first and second insulative housings 10', 20' in a rear-to-front direction and seal the rear ends of the housings 10', 20'. Each spacer 5' defines a plurality of through hole 51' only allowing the tail portions 33' of the contacts 3' passing therethrough. The spacer 5' can prevent plastic from seeping into the passageways 15' of the first and second insulative housings 10', 20' during the molding process of the cover 7'. The contacts 3' and the spacer 5' can be integrally formed before mounting to the first and second insulative housings 10', 20', if desired.

Figure 14:
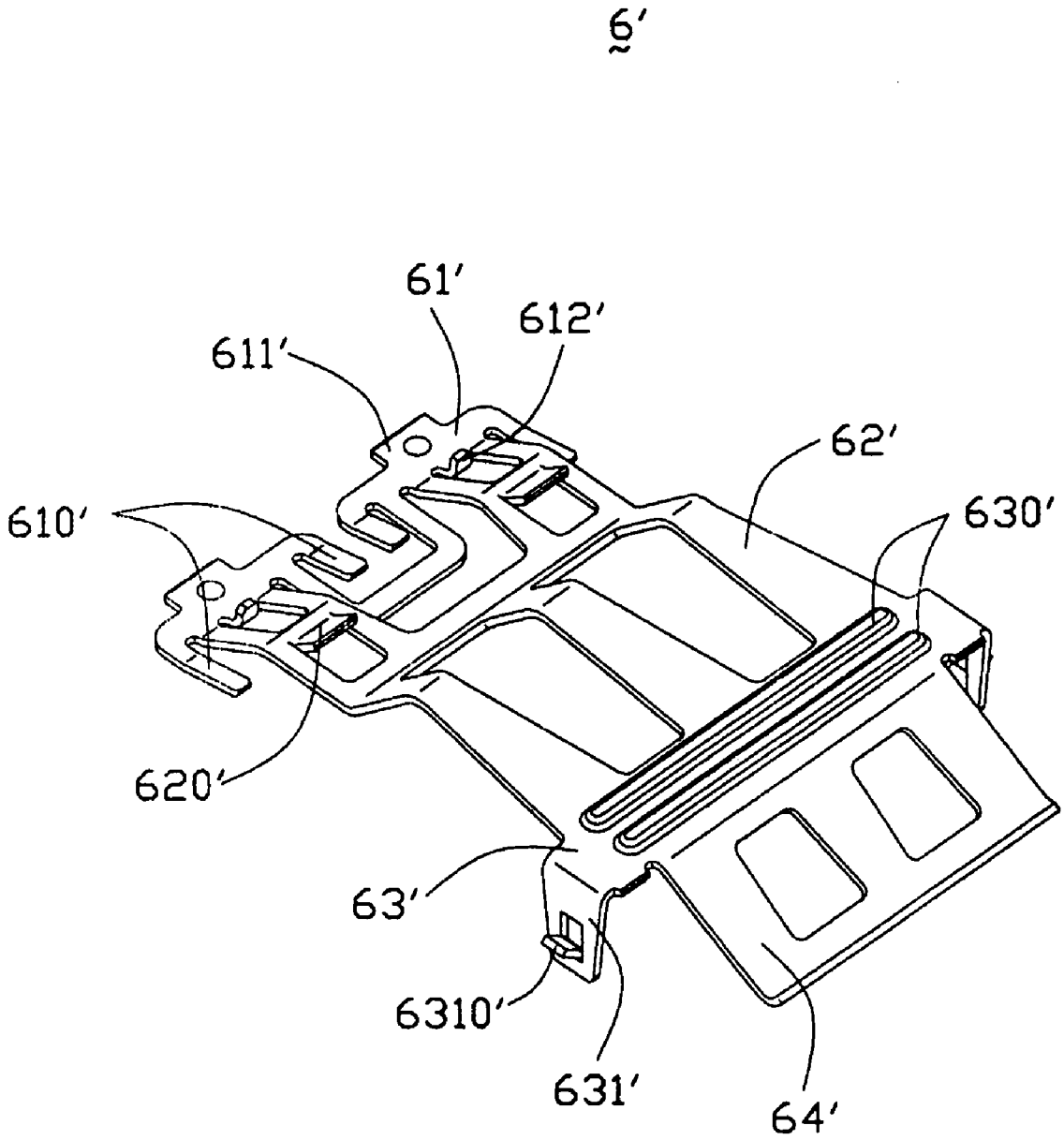
FIG. 14 is an enlarged view of a latch member of the connector assembly shown in FIG. 12.

Particularly referring to FIG. 14, each of the latch member 6' is stamped and formed from a metallic plate and comprises a retaining portion 61', a locking portion 62' extending upwardly and rearwardly from the retaining portion 61', a pressing portion 63' extending rearwardly from the locking portion 62', and a supporting portion 64' extending rearwardly and downwardly from the pressing portion 63'. The retaining portion 61' has two pairs of snap tabs 610' extending rearwardly and upwardly from a front end thereof, a pair of forwardly extending positioning tabs 611', and a pair of upwardly protruding curved stopping portions 612'. The locking portion 62' has a pair of latch tabs 620' protruding upwardly and rearwardly therefrom. The pressing portion 63' is formed with two holding ribs 630' on a top surface thereof, and a pair of side beams 631' extending downwardly from opposite ends thereof. Each side beam 631' is stamped with a spring tab 6310' extending outwardly therefrom.

Figure 15:
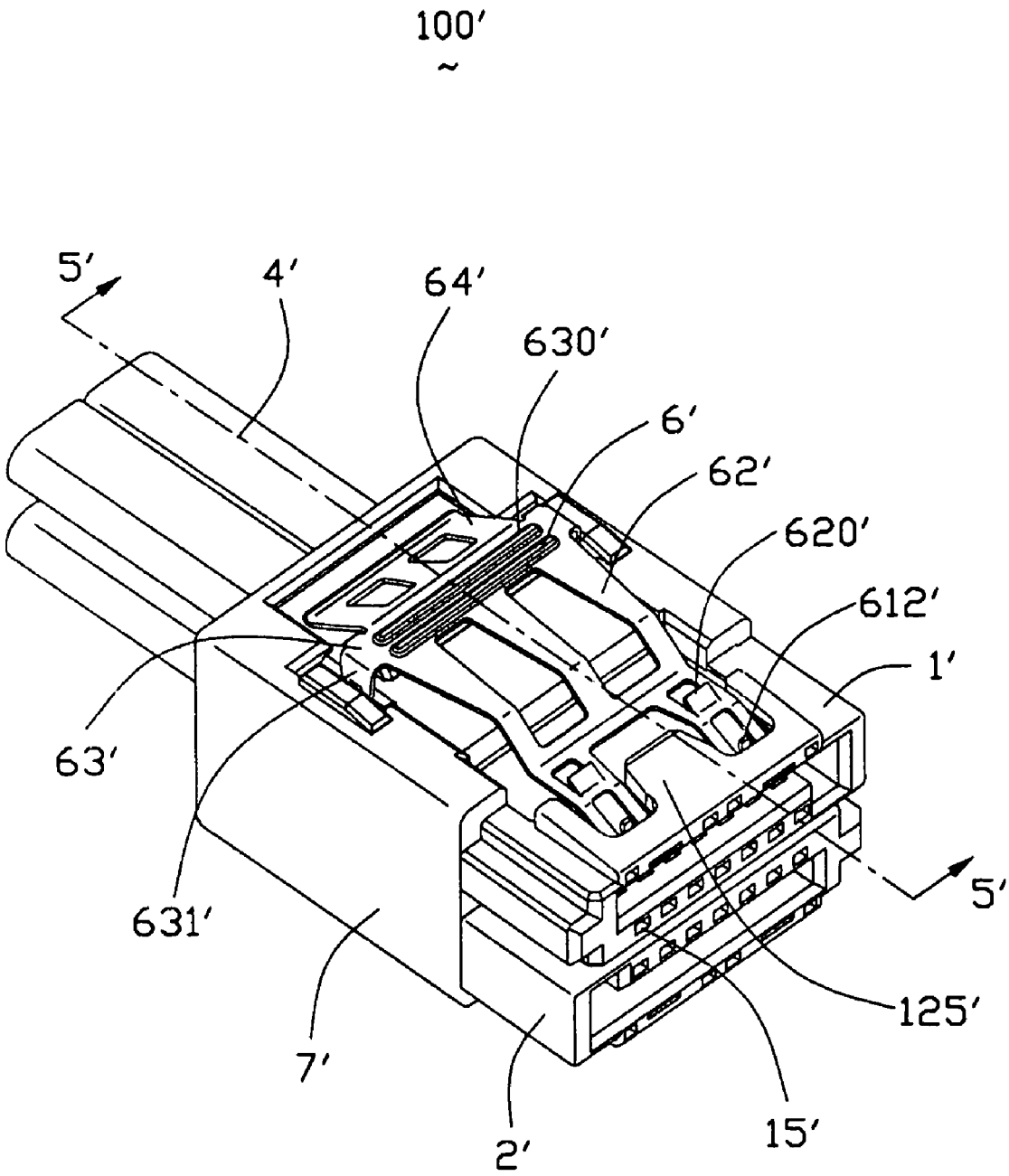
FIG. 15 is an assembled, perspective view of the connector assembly shown in FIG. 12.
Figure 16:
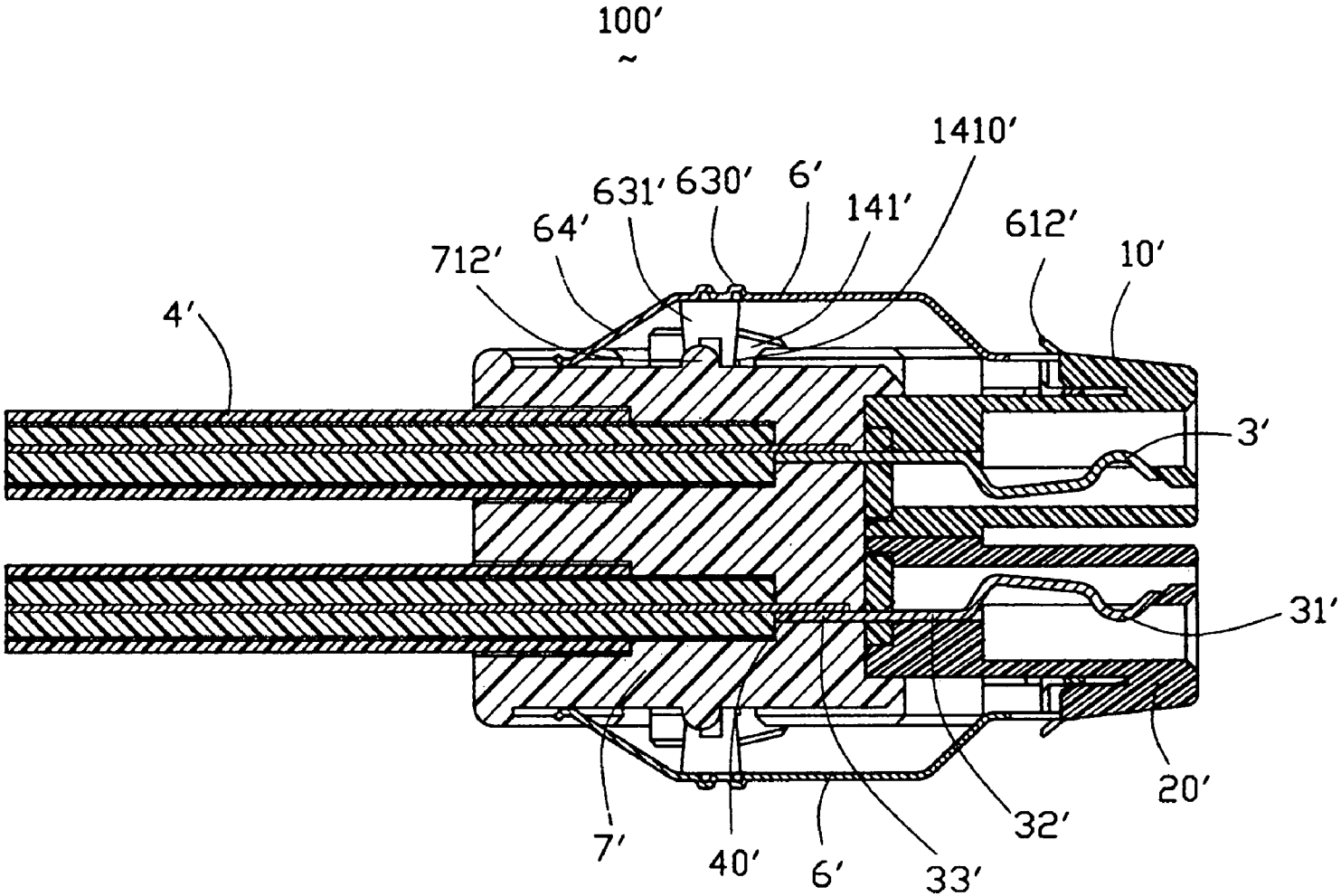
FIG. 16 is a cross-section view taken along line 5'—5' of FIG. 15.

In assembly, referring to FIGS. 15–16 in conjunction with FIGS. 12–14, the individual conductors 41' of the cable 4' are soldered to the tail portions 33' of the contacts 3', and extend through the first channel 74' and the second channel 76' into the first and second receiving spaces 71', 72'. The guiding posts 14' of the first and second housings 10', 20' are partially and respectively received in corresponding receiving spaces 71', 72', and the free ends 141' partially exposed beyond the passages 75'.

Particularly referring to FIGS. 15–16, one of the latch members 6' is mounted onto the first insulative housing 10' and the top wall 700' of the cover 7'. The latch member 6' is then assembled to the cover 7' and the first insulative housing 10' under a pressing force, with the side beams 631' thereof respectively partially inserted into the rear portions of the passages 75' and pushed adjacent to the free end 141' of the first insulative housing 10', with the positioning tabs 611' and the snap tabs 610' of the retaining portion 61' respectively pushed into the gap 182' and received in the corresponding first and second slots 129', 130' of the first insulative housing 10', and with the supporting portion 64' abutting against the top surface of the top wall 700' of the cover 7'. The spring tabs 6310' of the pressing portion 63' are pressed into the cutouts 1410' of the guiding posts 14' and are slideable therealong. The latch member 6' assembled on the bottom wall 702' of the cover 7' follows the same means of the latch member 6' assembled on the top wall 700' of the cover 7'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked connector assembly comprising:

at least a pair of connector bodies respectively defining a mating port for mating with complementary connectors;

a common housing encapsulating the connector bodies therein with the mating ports exterior accessible;

each of said connector bodies further comprising a latch member assembled on one side thereof;

a pair of pulling members respectively assembled to the common housing and movable along to a front-to-back direction to actuate said pair of latch members to move along a direction upwardly and perpendicular to said front-to-back direction to disengage from corresponding complementary connectors;

wherein the pulling members comprises a cooperating portion capable of actuating the latch member and an operating portion exposed outside of the common housing capable of being pulled rearward; and wherein said connector bodies are arranged in an upper row and a lower row such that the mating ports of the upper row and lower row are in a substantially mirror-image disposition relative to a line between the upper and lower rows.

2. The connector assembly as claimed in claim 1, wherein the common housing is formed with a pair of upper and lower covers and a common base interconnected with the upper and the lower covers.

3. The connector assembly as claimed in claim 1, wherein the common housing is formed with a pair of covers and a pair of bases interconnected with the pair of covers.

4. The connector assembly as claimed in claim 3, wherein the pair of bases of the common housing are stacked back-to-back to form a mirror-image relationship.

5. The connector assembly as claimed in claim 3, wherein the pair of bases are riveted with each other via at least a pair of nails.

6. The connector assembly as claimed in claim 1, wherein the latch member comprises engaging portion assembled with the common housing in a first direction, a latch portion extending in a second direction perpendicular to said first direction and an inclined connecting portion connecting the engaging portion with the latch portion.

7. The connector assembly as claimed in claim 1, wherein the connector body comprises a plurality of contacts and a cable electrically connecting with the contacts.

8. The connector assembly as claimed in claim 1, further comprising a pair of conductive shells assembled to upper and lower sides of the common housing, and wherein each shell comprises a tab pressing on a middle of corresponding latch member to provide restore force to the latch member after the latch member disengages from the complementary connector.

9. The connector assembly as claimed in claim 1, further comprising a gasket assembled to the common housing for reducing Electro Magnetic Interference in the signal transmission.

10. The connector assembly as claimed in claim 6, wherein the cooperating portion of the pulling member is capable of sliding along the inclined connecting portion of the latch member to actuate the latch member to disengage from the complementary connector.

11. The connector assembly as claimed in claim 7, the connector body further comprises a printed circuit board, and wherein the contacts are first and second conductive pads formed at opposite ends of the printed circuit board with the cable electrically connecting with the second conductive pads.

12. The connector assembly as claimed in claim 9, wherein the common housing comprising a base portion and a tongue portion extending forwardly from the base portion, and wherein the gasket is assembled to the tongue portion and abuts against the base portion.

13. A stacked connector assembly comprising:

a pair of upper and lower sub-connectors stacked with each other along a vertical direction;

a pair of cables connected to rear positions of the corresponding sub-connectors, respectively; and said pair of sub-connectors respectively defining a pair of mating ports in corresponding front portions thereof, wherein the mating port of the lower sub-connectors is similar to that of the upper sub-connectors while in an upside-down manner, wherein a pair of latch arms are disposed on two opposite outer sides of said stacked pair of upper and lower sub-connectors in said vertical direction so as to latch to corresponding complementary connectors, respectively;

a pair of pulling members respectively assembled to the stacked pair of upper and lower sub-connectors and movable along to a front-to-back direction to actuate said pair of latch arms to move along a direction upwardly and perpendicular to said front-to-back direction to disengage from corresponding complementary connectors;

wherein the pulling members comprises a cooperating portion capable of actuating the latch member and an operating portion exposed outside of the common housing capable of being pulled rearward.

14. The stacked connector assembly as claimed in claim 13, wherein said upper and lower sub-connectors are integrated by a common cover on which said pair of latch arms are located.

15. The stacked connector assembly as claimed in claim 13, wherein said pair of latch arms are deflectable toward each other in said vertical direction.

* * * * *